United States Patent [19]

Joosten et al.

[11] Patent Number: 4,506,491

[45] Date of Patent: Mar. 26, 1985

[54] CONTAINER STERILIZATION APPARATUS AND METHOD

[76] Inventors: Richard L. Joosten, 6226 Carpathian Ct., West Bloomfield, Mich. 48033; George A. Davis, Jr., 3224 Old Orchard, Brighton, Mich. 48116

[21] Appl. No.: 368,940

[22] Filed: Apr. 16, 1982

[51] Int. Cl.[3] ..... B65B 43/08; B65B 55/10

[52] U.S. Cl. ..... 53/426; 53/456; 53/563; 53/167; 493/165; 493/175; 493/472

[58] Field of Search ..... 53/426, 563, 167, 456; 422/33, 302; 493/165, 164, 472, 330, 175; 141/60

[56] References Cited

U.S. PATENT DOCUMENTS

| | | | |
|---|---|---|---|
| 2,367,884 | 1/1945 | Monroe | 493/164 X |
| 2,874,523 | 2/1959 | Ryan | 53/426 |
| 3,439,590 | 4/1969 | Rosenberg | 493/109 X |
| 3,566,575 | 3/1971 | Lisiecki | 53/467 X |
| 3,709,114 | 1/1973 | Johnson | 493/472 X |
| 3,789,888 | 2/1974 | James | 53/167 X |

*Primary Examiner*—John Sipos

[57] ABSTRACT

The disclosure illustrates and describes a sterilization apparatus and method for sterilizing the interiors of paperboard containers, wherein such apparatus and method are effective through the mandrel assembly on which the container bottom closures are formed and sealed. This is accomplished by forming longitudinal channels through each mandrel and connecting same to separate compartments formed within the hub, and providing means for communicating a suitable sterilant fog through respective compartments and channels at the station where each bottom-formed container is stripped from its respective mandrel. The usual fast stripping action tends to create a vacuum within the container which aids the dispersement of the fog onto the entire inside surface of the container, sterilizing it prior to the subsequent filling operation.

4 Claims, 7 Drawing Figures

CONTAINER STERILIZATION APPARATUS AND METHOD

TECHNICAL FIELD

This invention relates generally to sterilization techniques and, more specifically, to an improved apparatus and method for sterilizing thermoplastic coated, liquid carrying paperboard containers prior to their being filled and sealed on a forming, filling and sealing machine.

BACKGROUND ART

It is desirable from a marketing standpoint to increase the storage or shelf life of various comestible products. This is accomplished by employing various sterilization processes. Heretofore, sterilization of thermoplastic coated, liquid carryng paperboard containers has typically been acomplished on the forming, filling and sealing machine at a location between the station where the bottom formed container is stripped from an indexing mandrel and a station downstream thereof where the container is filled with a liquid, such as milk or juice. Such an arrangement is shown and described in Lisiecki U.S. Pat. No. 3,566,575, issued on Mar. 2, 1971.

DISCLOSURE OF THE INVENTION

A general object of the invention is to provide an improved sterilization apparatus and process which are highly efficient and compatible with existing forming, filling and sealing machines.

Another object of the invention is to provide a sterilization apparatus and a process which are functional in conjunction with the indexing sprocket and mandrel assembly currently included on many models of forming, filling and sealing machines.

A further object of the invention is to provide a sterilization apparatus wherein a channel is formed through the length of each mandrel, communicating with openings and compartments formed in the hub of the indexing sprocket and mandrel assembly, such that, as each mandrel reaches the 6:00 o'clock position, there is communication with a line leading from a generator which is capable of continuously producing a chlorine dioxide or hydrogen peroxide fog, thereby conveying such fog through the compartment and channel to the interior of the container as the latter is being mechanically stripped from the mandrel upon which it is slidably mounted.

These and other object and advantages of the invention will be apparent when reference is made to the following description and accompanying drawings.

BEST MODE OF CARRYING OUT THE INVENTION

Figure 1:
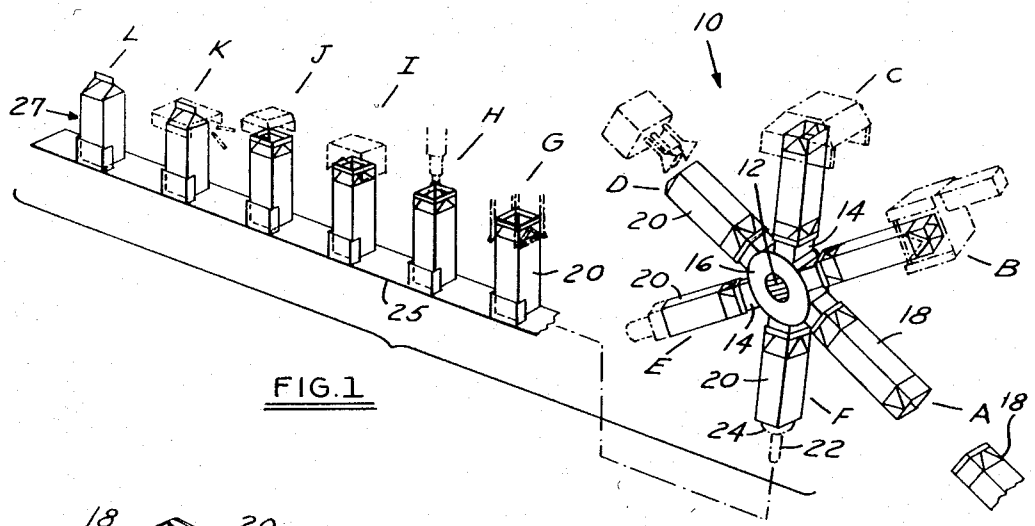
FIG. 1 is a perspective schematic view illustrating the steps encompassed in the method of forming, sterilizing, filling and sealing the container as it passes through a packaging machine.
Figures 2A, 2B, 2C, 2D:
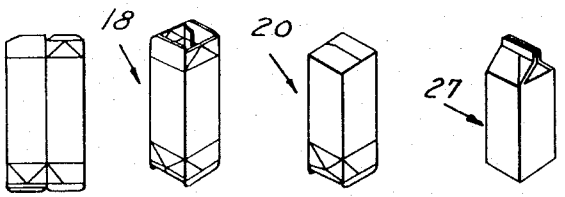
FIG. 2A is an illustration of a typical flat side seamed container blank as it would be loaded into the magazine of a packaging machine.
FIG. 2B is a perspective view of the container blank shown in FIG. 2A in open-ended and tubular form as it appears when mounted on a mandrel at station A in FIG. 1.
FIG. 2C is a perspective view of the container after the bottom closure panels have been sealed at station D in FIG. 1.
FIG. 2D is a perspective view of a filled and sealed container after passing through to the discharge station L of the machine.

Referring now to the drawings in greater detail, FIG. 1 illustrates an indexing mandrel assembly 10 mounted on a drive shaft 12, and including six equally spaced mandrels 14 extending radially from a central housing or manifold 16. Conventionally, a thermoplastic coated paperboard container blank 18 is removed from a magazine (not shown), opened into a square cross-sectional tubular shape, and slid onto a mandrel 14 at a load station A located in the 4:00 o'clock position, as viewed in FIG. 1. The sprocket mechanism 10 thereupon indexes to a bottom pre-breaker station B in the 2:00 o'clock position, prior to indexing to a bottom heat station C in the 12:00 o'clock position. The next index is to the bottom tuck and pressure station D at 10:00 o'clock, followed by transfer to a second pressure station E at 8:00 o'clock, and finally indexing to a combination sterilization and discharge or stripper station F at 6:00 o'clock. The stripping of the now bottom-sealed container, hereinafter referred to as container 20, is effected by a mechanical stripper 22 having a rubber vacuum cup 24 mounted on the end thereof for engagement with the closed and sealed bottom of the container 20.

In general, once the sealing of the bottom closure is completed, the container 20 is pulled downwardly by the mechanical stripper from the mandrel 14 at station F and deposited on suitable conveyor, represented at 25 in FIG. 1. As indicated above, the interior surfaces are sterilized during this downward motion. The container 20 is then acted upon at a top pre-breaker station G, such pre-breaking serving to facilitate the subsequent folding and sealing of the top closure. The container 20 is next conveyed to a filling station H where the product, such as milk or juice, is dispensed into the open end of the container. The container 20 next encounters a top partial folding or tucking station I, prior to indexing to a heating station J which prepares the thermoplastic top closure panels for transfer to a sealing station K where the top closure panels are brought together with a pressure and cooling action to become tightly sealed thereby into a completed gable top container 27, prior to delivery to a discharge station L.

Figure 3:
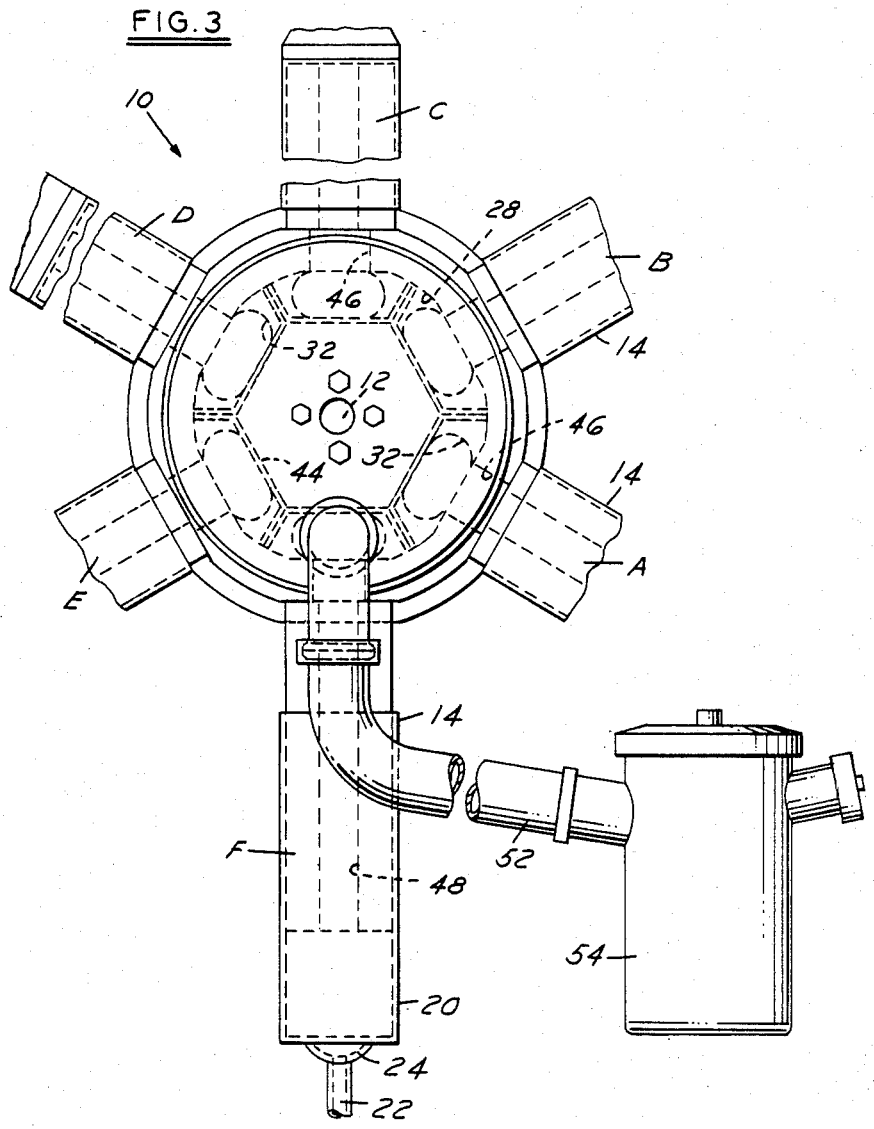
FIG. 3 is a an enlarged fragmentary front view of a bottom forming and sealing mechanism embodying the invention.
Figure 4:
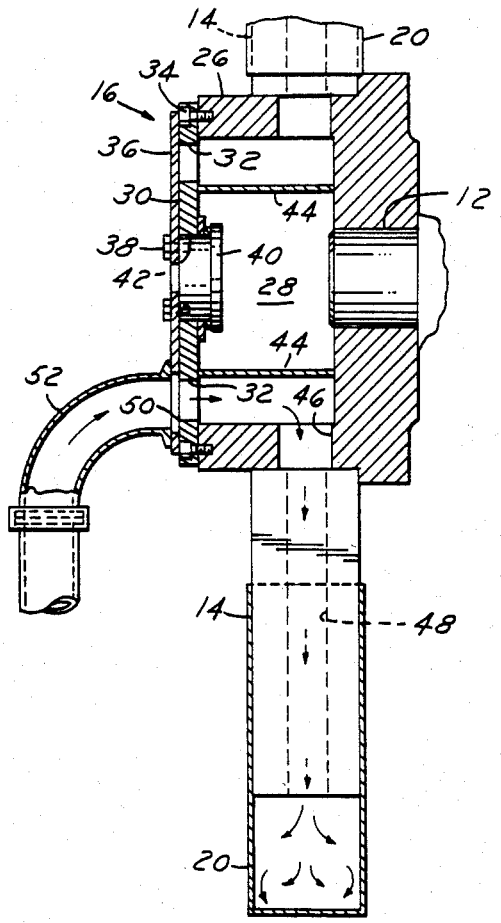
FIG. 4 is a fragmentary side elevational view in cross-section of a portion of the FIG. 3 structure.

As illustrated in FIGS. 3 and 4, the central housing 16 includes a hub 26 mounted on the drive shaft 12 and having a cylindrical chamber 28. A cover member 30 having six equally spaced apertures 32 formed therein is secured by screws 34 to the open end of the chamber 28. A plate member 36 is retained against the face of the cover member 30 by virtue of being secured by fasteners 38 to a center bushing 40 slidably mounted through a center opening 42 formed in the cover member 30. A compartment 44 is formed adjacent the radially inner end of each mandrel 14, in communication with the six apertures 32 in the cover member 30. Six equally spaced radial openings 46 are formed through the peripheral wall of the hub 26, serving to communicate between each compartment 44 and a channel 48 extending axially through each of the respective mandrels 14. The channel 48 replaces side reliefs (not shown) which are conventionally formed on the mandrel 14 to allow air to enter the package and prevent excessive vacuum build-up therein, hampering the stripping of the container from the mandrel.

A single opening 50 is formed in the fixed plate member 36 for communicating in turn with each of the openings 46 as the housing 16 indexes into the 6:00 o'clock position. A pipe or duct 52 is secured at one end thereof to the plate member 36 around the opening 50. The other end of the duct 52 is secured to a fog generator 54, the latter being any generator unit suitable for continuously emitting a chlorine dioxide or hydrogen peroxide fog at a low pressure of, say, 0.1 to 0.5 psig, into the duct 52.

container 20 is indexed on its respective mandrel 14 into the six o'clock position, it is automatically subjected to a fog communicated thereto from the generator 54 via the duct 52, the opening 50, one of the apertures 32, the adjacent compartment 44 and opening 46, and downwardly through the channel 48 of the mandrel 14 on which the container 20 is mounted.

As the container 20 is pulled off or stripped from the mandrel 14 at high speed by the vacuum cup 24 of the stripper 22, a vacuum tends to be generated within the container enhancing the flow of sterilant fog into the container and uniformly dispersing such fog onto the entire inside surface of the container, without interference. In other words, there is no need to displace atmospheric air from inside the package, as is the case with other known sterilizing techniques. When air is present, it tends to somewhat dilute the fogged sterilant as it enters the container.

In the event that hydrogen peroxide is used as the sterilizing agent, it would be necessary to include a drying or heating unit (not shown) between stations G and H, which would serve to remove the hydrogen peroxide residue from inside the container prior to filling the container with the desired product.

INDUSTRIAL APPLICABILITY

It should be apparent that the inventive sterilization apparatus provides an improved means for sterilizing bottomformed and sealed containers in a manner which does not require additional stations along a forming, filling and sealing machine for performing the sterilization operation.

It may be further apparent that such sterilization apparatus serves to intermittently distribute the chlorine dioxide or hydrogen peroxide fog throughout any machine enclosure (not shown) in which the indexing mandrel assembly 10 is mounted once the container 20 is stripped from a mandrel 14 and while the mandrel is indexing from the 6:00 o'clock position to the 4:00 o'clock position to receive another tubular container blank 18 from a magazine (not shown). This feature thus serves to continuously sterilize the complete mandrel assembly 10 all the while that it is operational.

It should also be apparent that, rather than having channels formed through the longitudinal center of each mandrel, slots or reliefs may be formed along the full length of oppositely disposed sides of the mandrel and covered by a suitable thin plate to form passageways for transmitting the sterilant fog from the respective hub compartments to the interior of the containers.

It should also be noted that the subject sterilization apparatus and process are applicable to any mandrel assembly arrangement, i.e., one which rotates in a vertical plane, as described above, or one which rotates in a horizontal plane, and is further applicable to either arrangement, whether it operates in an indexing mode or whether it rotates continuously.

While but one embodiment of the invention has been shown and described, other modifications thereof are possible.

The embodiments of the invention in which an exclusive property or privilege is claimed are defined as follows:

1. A sterilization apparatus for rigid containers, said apparatus comprising a mandrel, a tubular container slidably mounted on said mandrel and having the outer end thereof sealed against said mandrel so as to be completely filled by said mandrel, a longitudinal channel formed in said mandrel, a source of sterilant fog for supplying a sterilant under substantially no pressure with no positive sterilant feeding means, duct means for communicating said sterilant fog from said source to said channel and thence to the interiors of said containers while each is being slidably stripped from said mandrel, means for stripping said container from said mandrel thereby creating vacuum in said container in the space progressively vacated by the mandrel without the use of a vacuum forming means to draw the sterilant into the container as it is being stripped from the mandrel.

2. A sterilization apparatus for paperboard containers, said apparatus comprising an indexable manifold, a cover member mounted on said manifold, a plurality of equally spaced mandrels extending radially from said manifold, containers slidably mounted seriatim on each of said mandrels, means for sealing the outer end of each of said containers against said mandrels so as to be completely filled by said mandrels, at least one channel extending longitudinally through each of said mandrels, a plurality of compartments formed in said manifold, a plurality of openings formed through the wall of said manifold communicating between respective compartments and channels, a plurality of openings formed through said cover member and aligned with respective compartments, a fixed plate member mounted adjacent said cover member, a single opening formed in said plate member, a generator for generating a continuous sterilant fog under substantially no pressure with no positive sterilant feeding means, a duct communicating between said generator and said single opening as each mandrel is indexed into a location adjacent said single opening, and means for slidably stripping said containers from said respective mandrels at said location to thereby create a vacuum in the progressively expanding space within said respective containers adjacent the end of said respective mandrels without the use of a vacuum forming means thereby drawing said sterilant fog into said space and sterilizing said containers.

3. A method for sterilizing a rigid container prior to its being filled with a liquid, said method comprising the following steps:

(a) Slidably mounting a tubular, open-ended container on a mandrel having a longitudinal opening formed therethrough;

(b) Sealing the outer end of said container against said mandrel so as to be completely filled by said mandrel;

(c) Providing communication between a source of a sterilant in a fog state and said longitudinal opening of said mandrel, said sterilant being under substantially no pressure with no positive sterilant feeding means;

(d) Stripping said container from said mandrel, thereby creating a vacuum within the container without the use of a vacuum forming means and, thus, drawing said sterilant into the container and enhancing the covering of the container's interior surfaces with said sterilant; and (e) Conveying said sterilized container through top folding, filling, heating and sealing stations.

4. A method for sterilizing a paperboard container prior to its being filled with a liquid, said method comprising the following steps:

(a) At a first station, slidably mounting a tubular, open-ended container on each mandrel of a plurality of indexable mandrels, each mandrel having a longitudinally oriented opening formed therethrough;

(b) Heating the outer end of each container at a second station;

(c) Sealing said heated outer end of each container at a third station against said mandrels so as to be completely filledby said mandrels;

(d) Providing communication between a source of a sterilant in a fog state under substantially no pressure with no positive sterilant feeding means and the inner end of the opening through each mandrel at a fourth station;

(e) Stripping said container from said mandrel at said fourth station, thereby creating a vacuum within the container without the use of a vacuum forming means and, thus, pulling said sterilant into said container for covering the interior surfaces thereof;

(f) Conveying said sterilized container to a liquid filling station and filling said container;

(g) Conveying the filled container to a heating station and heating the open end thereof;

(h) Conveying the filled and heated container to a sealing station and sealing the top thereof; and (i) Discharging the filled container.

* * * * *

UNITED STATES PATENT AND TRADEMARK OFFICE

CERTIFICATE OF CORRECTION

PATENT NO. : 4,506,491
DATED : March 26, 1985
INVENTOR(S) : Richard L. Joosten and George A. Davis, Jr.

It is certified that error appears in the above-identified patent and that said Letters Patent are hereby corrected as shown below:

On the title page;

[73] Assignee: Ex-Cell-O Corporation, Troy, Michigan
Attorney, Agent, or Firm - John P. Moran Signed and Sealed this

*Twentieth* Day of *August 1985*

[SEAL]

*Attest:*

DONALD J. QUIGG

*Attesting Officer* *Acting Commissioner of Patents and Trademarks*